United States Patent [19]

Porter

[11] 3,943,979

[45] Mar. 16, 1976

[54] AUTOMATIC TEMPLE FOR WEAVING LOOMS

[75] Inventor: Allan William Henry Porter, Lustmuhle, Arbon, Switzerland

[73] Assignee: Saurer A.G., Switzerland

[22] Filed: Jan. 24, 1975

[21] Appl. No.: 543,890

[30] Foreign Application Priority Data

Jan. 25, 1974 Switzerland ..... 1068/74

[52] U.S. Cl. ..... 139/296; 26/65

[51] Int. Cl.[2] ..... D03J 1/22

[58] Field of Search ..... 139/292–301, 139/291 R, 304; 26/65; 29/121 R, 121 A, 121 H

[56] References Cited

UNITED STATES PATENTS

| | | | |
|---|---|---|---|
| 2,594,846 | 4/1952 | Bechter | 139/295 |
| 3,269,150 | 8/1966 | Haehnel | 139/304 X |
| 3,771,573 | 11/1973 | Horn et al. | 139/294 |

FOREIGN PATENTS OR APPLICATIONS

| | | | |
|---|---|---|---|
| 768,275 | 2/1957 | United Kingdom | 139/296 |
| 252,997 | 11/1948 | Switzerland | 139/291 R |
| 1,062,313 | 3/1967 | United Kingdom | 139/292 |
| 533,856 | 2/1941 | United Kingdom | 29/121 A |

*Primary Examiner*—James Kee Chi
*Attorney, Agent, or Firm*—McGlew and Tuttle

[57] ABSTRACT

An automatic temple for feeding a web in weaving looms, includes a hollow tubular bar of a length comparable to the entire weaving width and which has a bore with a slot in the wall thereof extending outwardly from the bore and longitudinally between the ends of the hollow tubular bar. A circularly cylindrical rod is of a greater diameter than the slot and is disposed within the bore of the hollow tubular bar and it is rotatable therein for winding the web therearound which is fed into the slot around the rod and out the slot at a spaced location from its entrance. The cylindrical rod has hollow tubular end portions and it is also movable during winding against the slot. The cylindrical rod has a plurality of circumferentially spaced longitudinally extending keyways defined through its hollow end portions and a plurality of keys are guided for radial movement in the keyways and they have outer ends with needle points. The keys are displaceable radially so as to alternately project and withdraw the needle points from the surface of the cylindrical body. Drive means are connected between the cylindrical rod and the keys to cause the keys to cyclically extend and withdraw the needle points during operation.

5 Claims, 2 Drawing Figures

AUTOMATIC TEMPLE FOR WEAVING LOOMS

FIELD AND BACKGROUND OF THE INVENTION

This invention relates in general to the construction of weaving looms and, in particular, to an automatic temple for weaving looms.

DESCRIPTION OF THE PRIOR ART

The present invention is particularly directed to automatic temples for weaving looms, wherein a web is wrapped around a rotatable cylindrical rod, which is located in a tubular bar, the web entering and going out of the interior of the hollow bar through a slot as it is fed. These so-called "Lupton" temples can be set very close to the fell of the cloth because of their small cross-section and because they extend over the entire weaving width and they favor a uniform interlacing of the filling yarn. The known temples of this kind have the drawback that, with finer weaving material, their stretching effect is insufficient. An improvement is obtained if the outer circumference of the rod end portions is provided with helical grooves.

Another known type of temple with a good stretching effect is a so-called spike-disc temple, which is equipped with needle points which are actuated to stick into the selvedge. Such temples, however, are bulky so that they cannot be mounted close to the fell of the cloth, as is the case with the known "Lupton" temples.

SUMMARY OF THE INVENTION

The present invention provides an improvement over the "Lupton" temples in a construction which is effective to improve the stretching effect of such temples. For this purpose, and in accordance with the invention, at least the ends of the cylindrical rod are designed as tubular portions having a plurality of circumferentially spaced longitudinal keyways which extend through the wall of the tubular portion. Longitudinal keys are provided in the keyways with needle point which project at least approximately radially to the outside and are placed and guided in each of the keyways for the positive longitudinal displacement. Advantageously, the longitudinal motion of the keys is obtained by guiding their end portions in an oblique annular grove which is provided in a guide body connected to the hollow bar and secured in a stationary position against rotation. In addition, a radial piercing of the selvedge zone by the needle points during rotation of the rod to produce an anchorage of the web to the keys is advantageously obtained by providing a bolt which extends parallel to, and eccentrically of, the rod in each of the tubular end portions of the rod and is fixed in the guide body. The bolt extends through a bore of the guide body in which it is fixed, and the longitudinal keys bear against its circumferential surface. The rod is mounted for turning eccentrically relatively to the bolt so that, with its continuous turning, the longitudinally displaceable keys are moved with their needle points into and out of the longitudinal keyways over at least a part of the peripheral ranges which are enveloped by the web.

Accordingly, it is an object of the invention to provide an automatic temple for feeding a web in weaving looms, which comprises a hollow tubular bar having a bore therein which opens through a slot to the exterior, with a cylindrical rod of greater diameter than the slot, rotatable within the bore of the hollow bar, and having a guide body connected to each end of the tubular bar, at least the ends of the rod being tubular and having a plurality of circumferentially spaced longitudinally extending keyways which extend through the wall thereof, with keys in the keyways guided for radial and longitudinal movement and being displaceable radially and longitudinally, the keys having needle points which are projected and withdrawn from the outer surface of the cylindrical rod, the guide body being fixed against rotation relatively to the hollow bar and having means connected to the keys to cause their radial and longitudinal movement as the rod rotates.

A further object of the invention is to provide an automatic temple for weaving looms which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 2:
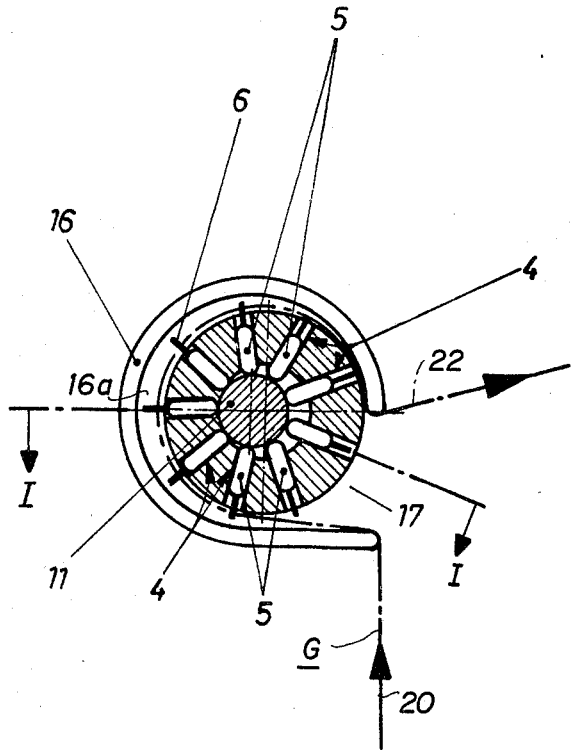
FIG. 2 is a section taken along the line II—II of FIG. 1.

Referring to the drawings in particular, the invention embodied therein, comprises an automatic temple for feeding a web in a weaving loom, which includes a rod 1, which is rotatably mounted within a cylindrical hollow bar 16 having a bore 16a. A web G, a shown in FIG. 2, is fed through a longitudinal slot 17 of the hollow bar 16 and, around part of the surface of the rod 1, in the direction of arrow 20. The web, after passing around rod 1, is directed outwardly from slot 17 in the direction of arrow 22.

Rod 1 is provided with a helical groove 2 which extends over at least a portion of rod 1 in order to improve the stressing effect on web G.

In accordance with the invention, at least each end of rod 1 is tubular and also operatively connected to longitudinally and radially displaceable keys 5 which are movable in longitudinal keyways 4 which extend radially through the bore wall of the tubular rod ends. The exterior periphery of each key carries one or more projecting needle points 6, and the keys are cyclically displaced radially into and out of its associated keyway so that the needle points are projected and withdrawn from the surface of the rod during operation.

Guide body 10 has a bore which is provided with an inclined (or oblique) groove 12, and each key is provided with an extension 7 having a nose portion 8. Extension 7 is guided in an annular clearance which is formed between the bore 9 of guide body 10 and a bolt 11 which extends coaxially through bore 9 and is connected to the guide body 10 by means of a pin 13 so as to be fixed against rotation. The free end of bolt 11 is provided with an eccentric collar 14 which extends into the bore 3 of the rod 1. Bolt 11 is secured in position to the guide body 10 so that its center line is offset from the center line of collar 14. Collar 14 in turn is centered on the center line of the rod 1 within the bore 3.

The guide body is fixed against rotation by a connection to the hollow bar 16, which is not shown. Extensions 7 of the longitudinal keys are guided in guide body 10 by the bore 9, so that the keys permanently apply against the circumferential surface of the bolt 11. The eccentricity of the collar 14, the radial extension of the keys, and the length of the needle points 6 are chosen so that, during a complete revolution of rod 1, the outer surfaces of keys 5 project up to, and cyclically move radially below, the outer circumference of rod 1, whereas, the needle points do not permanently remain inside this outer circumference.

Figure 1:
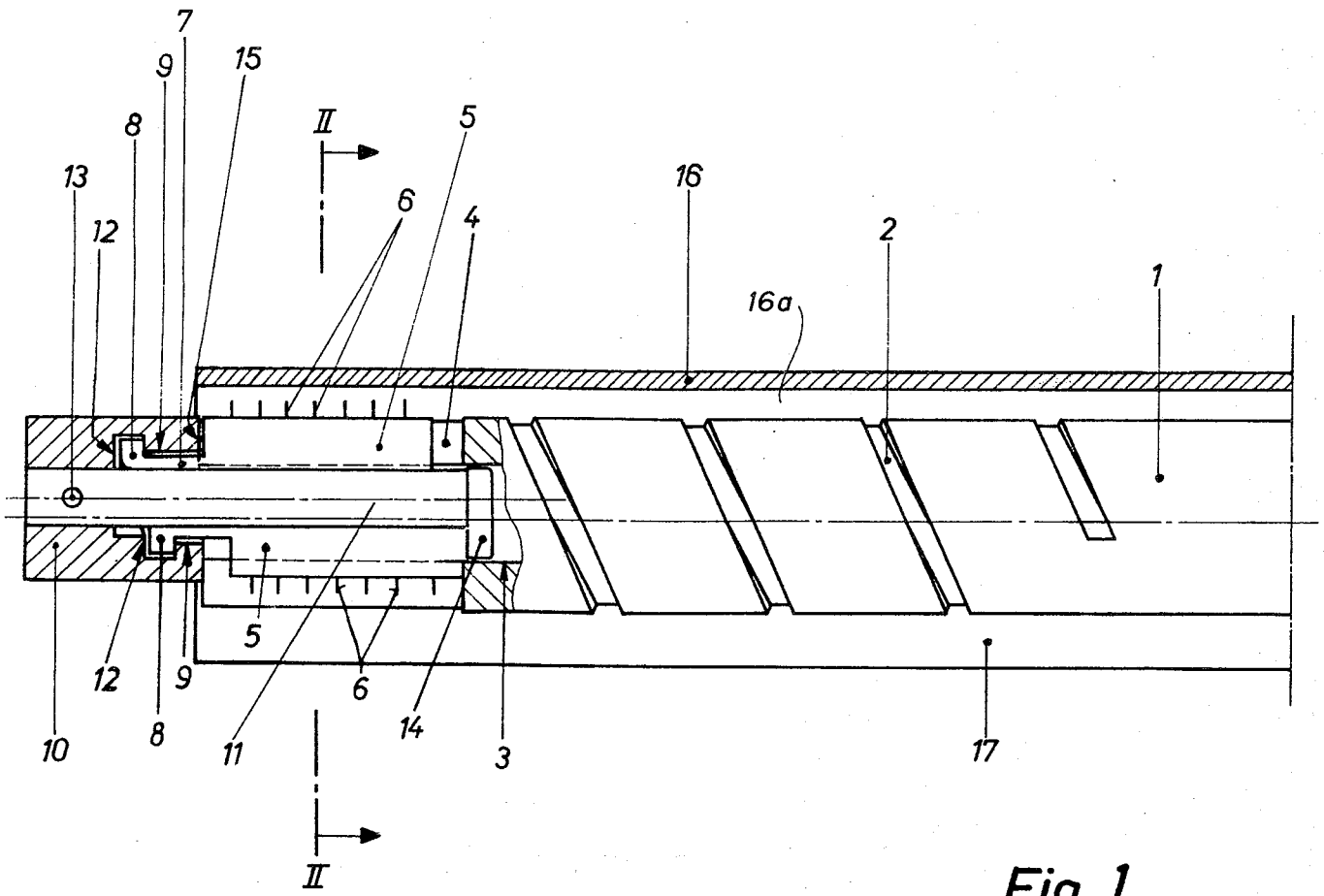
FIG. 1 is a partial elevational and partial sectional view of one end of a temple constructed in accordance with the invention and taken along the line I—I of FIG. 2.

The temple operates as follows:

The web G enters the hollow bar through the longitudinal slot 17, and the bar is secured to the machine frame near the cloth fell (not shown). The web loops around rod 1 and leaves the hollow bar again at the upper side of slot 17 to be passed over the usual rollers (not shown) and wound on the cloth beam. Within the circumferential range, in which the web contacts rod 1, the selvedge or selvages of the web are pierced by the needle points 6 provided on the keys 5 which have been moved in keyways 4 radially outwardly where a positive connection is established between the keys and the web so that a pressure is produced between the front surface 15 of the guide body 10 and the end surface of rod 1 by the stretching force on the web. At each step of winding of web G on the cloth beam, rod 1 is positively put into rotary motion, whereby, keys 5 change step-by-step, their angular position relative to the guide body 10. The radial and axial position of the keys changes as a function of their orientation in the annular clearance due to the fact that they ride on the eccentrically positioned bolt 11 in bore 3 or rod 1. The longitudinal shifting motion which is effected by nose 8 engagement in the continuous groove 12 causes a corresponding shifting movement of the needle points 6 with the keys 5. By carefully selecting the direction of eccentricity of the bolt 11 and the direction of slope of the groove 12 or its axial shift around the circumference of the associated guide body 10, the effect is obtained that, each time the needle points 6 rise from the longitudinal keyways 4, as their position is shifted in respect to the bolt 11, the keys move in the direction of the rod end, that is, to the left, as shown in FIG. 1. These directions may therefore be chosen or adjusted in respect to each other so that each key reaches its extreme end position at the very instant at which its needle points 6 moving backwardly into the respective longitudinal keyway is just withdrawing in this again. At this instant and location, the web is leaving contact with the rod and going out from the bore of the tubular bar 16 through the longitudinal slot 17.

While a specific embodiment of the invention has been shown and described in detail to illustrate the application of the principles of the invention, it will be understood that the invention may be embodied otherwise without departing from such principles.

What is claimed is:

1. An automatic temple for feeding a web in weaving looms, comprising a stationary hollow bar having a bar bore and having a slot extending outwardly from said bar bore and longitudinally between the ends of said hollow bar, a circularly cylindrical rod of greater diameter than said slot arranged in the bar bore of said hollow bar and being rotatable for winding the web therearound which is fed into the slot around said rod and out said slot, at least the ends of said rod being tubular and having a rod bore, a guide body disposed alongside each end of said rod and being secured to said hollow bar for preventing the rotation thereof, a plurality of circumferentially spaced longitudinal keyways extending through the wall of the tubular part of said rod, a key guided for radial and longitudinal movement in each of said keyways and each having an outer end with a needle point and being radially movable so as to alternately project and withdraw said needle points from the surface of said rod, and means associated with said rod and said guide body to displace said keys upon rotation of said rod.

2. An automatic temple, according to claim 1, wherein said means for displacing said keys upon rotation of said include a guide bore defined in said guide body having a groove, the guide bore being parallel to the rod bore of said rod, a bolt member in the guide bore of said guide body and extending into the rod bore of said rod and being eccentrically positioned in respect to the rod bore of said rod, said keys riding on the periphery of said bolt member and said bolt member being secured to said guide body so that during rotation of said rod, said keys are shifted radially, and said keys having a nose portion engaged in said groove so that during rotation, said keys are also shifted axially as said nose portion rides in said groove.

3. An automatic temple, according to claim 1, wherein the groove of said guide body comprises an oblique annular groove.

4. An automatic temple, according to claim 1, wherein each of said keys is provided with an extension having said nose which engages in said groove.

5. An automatic temple, according to claim 1, wherein said bolt member includes a collar portion, the end thereof which extends into the rod bore of the tubular part of said rod and which is concentrically arranged therein but which is eccentric to the remaining portion of said bolt member, said remaining portion of the bolt member being located as to be in contact with the rod bore of said rod, said keys comprising longitudinally elongated members bearing axially along the length of said bolt, said collar and the end of said bolt which is retained by said guide body holding said bolt so as to be eccentric to the bore of the tubular part of said rod so that said keys are alternately moved radially inwardly and outwardly during rotation of said rod.

* * * * *